US009526306B2

(12) United States Patent
Fitzgerald et al.

(10) Patent No.: US 9,526,306 B2
(45) Date of Patent: Dec. 27, 2016

(54) UMBRELLA ASSEMBLY

(71) Applicant: Ellen D. Fitzgerald, Rochester, NY (US)

(72) Inventors: Ellen D. Fitzgerald, Rochester, NY (US); Jeffrey R. Lake, Pittsford, NY (US)

(73) Assignee: Ellen D. Fitzgerald, Rochester, NY (US)

( * ) Notice: Subject to any disclaimer, the term of this patent is extended or adjusted under 35 U.S.C. 154(b) by 0 days.

(21) Appl. No.: 14/633,893

(22) Filed: Feb. 27, 2015

(65) Prior Publication Data

US 2015/0245691 A1 Sep. 3, 2015

Related U.S. Application Data

(60) Provisional application No. 61/946,117, filed on Feb. 28, 2014.

(51) Int. Cl.
*A45B 19/00* (2006.01)
*A45B 11/00* (2006.01)

(52) U.S. Cl.
CPC ..... *A45B 19/00* (2013.01); *A45B 11/00* (2013.01); *A45B 2019/008* (2013.01)

(58) Field of Classification Search
CPC ... A45B 25/14; A45B 2200/1009; A45B 3/04; A45B 19/00; A45B 19/04; A45B 2019/002; A45B 2019/008
USPC ..... 135/15.1, 16, 19.5, 20.3, 25.41, 28, 2, 34,135/27
See application file for complete search history.

(56) References Cited

U.S. PATENT DOCUMENTS

| | | | | |
|---|---|---|---|---|
| 2,183,833 | A * | 12/1939 | Farhar | A45B 25/14 135/120.2 |
| 2,788,792 | A * | 4/1957 | Koller | A45B 25/22 135/15.1 |
| 3,534,752 | A * | 10/1970 | Vanzini | A45B 3/04 135/22 |
| 3,709,238 | A * | 1/1973 | Leopoldi | A45B 19/00 135/15.1 |
| 6,273,111 | B1 * | 8/2001 | Weiss | A45B 19/00 135/15.1 |
| 7,069,939 | B1 * | 7/2006 | Conde | A45B 25/00 135/16 |
| 8,225,806 | B1 * | 7/2012 | Simonelli | A45B 25/14 135/19.5 |
| 8,733,378 | B2 | 5/2014 | Tayebi | |
| 8,857,453 | B2 | 10/2014 | Souma | |
| 2009/0223545 | A1 | 9/2009 | Beyer et al. | |
| 2009/0293924 | A1 | 12/2009 | Ham | |
| 2012/0073616 | A1 | 3/2012 | Kuelbs | |
| 2013/0306118 | A1 | 11/2013 | Souma | |

FOREIGN PATENT DOCUMENTS

| | | | | |
|---|---|---|---|---|
| FR | 2681224 | A1 * | 3/1993 | A45B 19/00 |

* cited by examiner

*Primary Examiner* — Winnie Yip
(74) *Attorney, Agent, or Firm* — Barclay Damon, LLP

(57) ABSTRACT

An umbrella assembly, in one embodiment, includes a housing for a canopy. The umbrella assembly has a mechanism powered to open and close the canopy. During opening, the canopy slides upward through the housing and extends outward in a blooming formation.

20 Claims, 9 Drawing Sheets

UMBRELLA ASSEMBLY

CROSS-REFERENCE TO RELATED APPLICATION

This application is a non-provisional, and claims the benefit and priority of, U.S. Provisional Patent Application No. 61/946,117, filed on Feb. 28, 2014. The entire contents of such application are hereby incorporated by reference.

BACKGROUND

Conventional umbrellas are known to keep users dry during rainfall. They are notorious for being damaged easily by environmental elements in addition to being cumbersome to deploy and retract. These drawbacks make the conventional umbrella less suited for the variety of situations where its ability to protect a user from environmental elements would be beneficial. There are known umbrellas that are motorized to reduce the manual labor involved, but these umbrellas tend to suffer from additional problems such as interference with objects when opening and closing, relatively high complexity, inadequate stability, lack of modularity, lack of portability and lack of versatility.

SUMMARY

One aspect disclosed herein provides an umbrella assembly which automatically opens and closes. Depending upon the embodiment, the umbrella assembly can be fully automated or partially automated. The umbrella assembly is configured to be coupled to a variety of different types of structures as described below.

In one embodiment, the umbrella assembly has an elongated housing, a plurality of elongated ribs configured to be at least partially housed within the housing, a canopy coupled to the elongated ribs, where the canopy is configured to be housed within the housing, a position control assembly configured to be at least partially housed within the housing, and at least one stop member coupled to the housing. The position control assembly includes a drive member configured to move the elongated ribs between a closed position in which the canopy is housed within the housing, and an open position in which the portions of the elongated ribs extend outside the housing. The position control assembly further includes at least one rib steering device coupled to each of the elongated ribs. The rib steering device is configured to control the angle of the elongated rib relative to the axis. The rib steering devices also stabilize the canopy to withstand an upward force of environmental elements. The stop member is configured to support the elongated ribs when the elongated ribs are in the open position and stabilize the canopy to withstand a downward force of environmental elements.

Additional features and advantages of the present disclosure are described in, and will be apparent from, the following Brief Description of the Drawings and Detailed Description.

DETAILED DESCRIPTION

Figure 1:
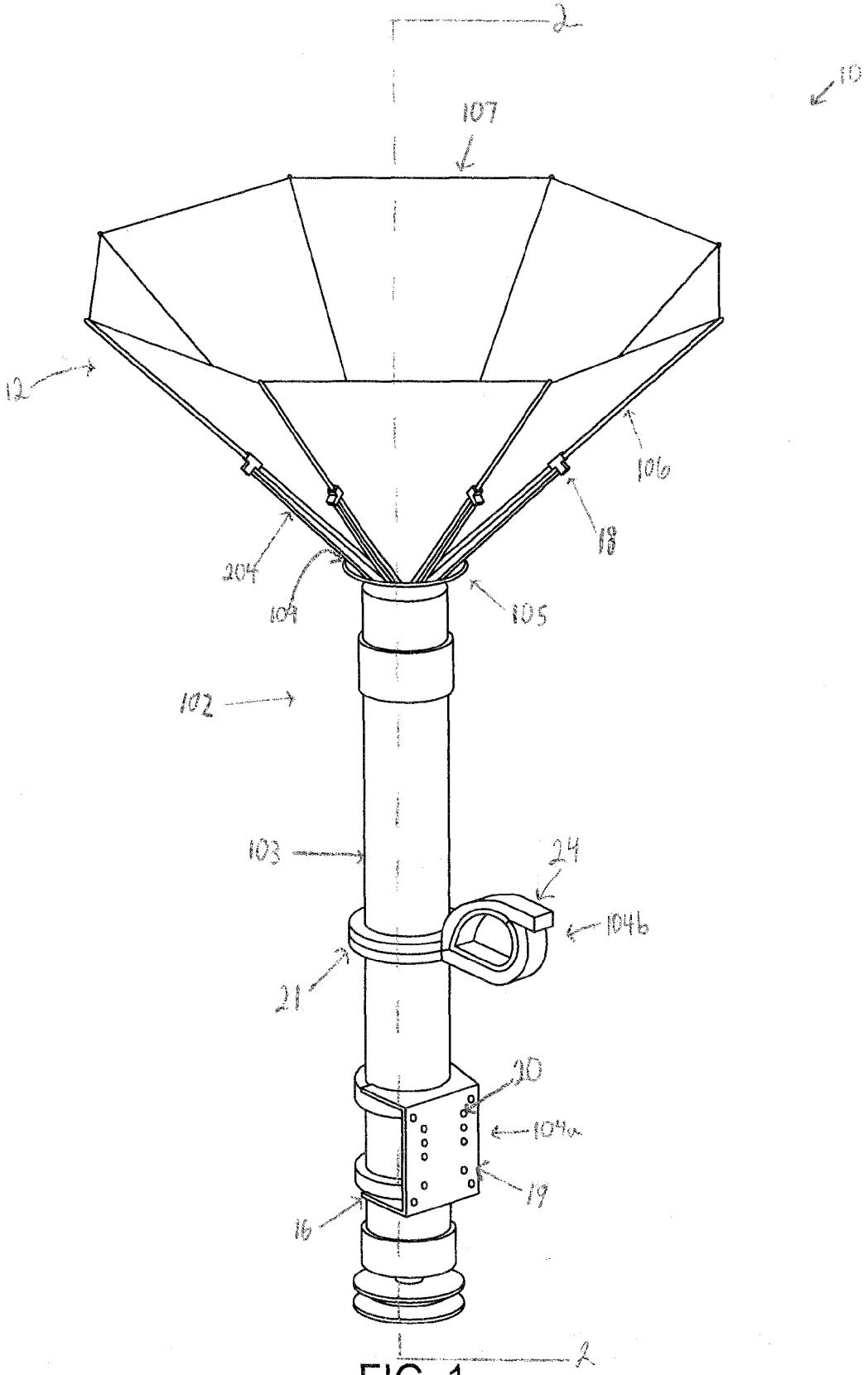
FIG. 1 is an isometric view of an embodiment of the umbrella assembly in a partially open position.

Referring to FIG. 1, the umbrella assembly 10, in one embodiment, includes an encasement, case or housing 103 and one or more couplers 104*a*, 104*b* attached to the housing 103. The housing 103 allows for containment, storage, protection and mobility of the umbrella sub-assembly 12 described below, including the flexible shield, guard, cover or canopy 107 illustrated in FIGS. 1 and 5. The housing 103 has an upper end 102 with an outlet, opening or aperture 109 from which deployment and retraction of the canopy 107 occurs. The different couplers 104*a*, 104*b* integrated into, fitted onto or secured to the housing 103, allow the housing 103 to be attached to a variety of structures, including, but not limited to, a backpack unit for a mail carrier, for example, handbag, suitcase, vehicle, golf cart, stroller, wheelchair, scooter, variety of types of chairs (e.g., beach chair and lawn chair), variety of types of tables (e.g., picnic table, patio table and beach table), buildings, sidewalk, beach, ground, pavement, floor and outdoor electrical devices, such as kiosks and displays screens.

In one embodiment, coupler 104*a* has a plurality of arms 16 and a mounting platform 19. The arms 16 define a passageway configured to engage, and securely receive, the housing 103. A set of screws or other suitable fastener can tighten the arms 16 onto the housing 103. The platform 19 defines a plurality of different sets of hole patterns 20, where each set is associated with a different structure. For example, hole pattern A can enable attachment to a golf cart, and hole pattern B can enable attachment to a kiosk computer. In another embodiment, coupler 104*b* has a clamp configuration 21 that surrounds the housing. The clamp may be hinged such that it can be opened to accept the housing and closed to clamp onto the housing. In another embodiment, the clamp may have an adjustable diameter which allows it to be placed over an end of the housing and adjusted to properly clamp onto the housing. The coupler 104*b* also has a coupling portion 24. In the embodiment shown, the coupling portion 24 defines a hole configured to slideably couple the housing to a structure such as the frame of a wheelchair. The coupling portion may be adjustable to enable secure coupling to a variety of structures. In another embodiment, the coupling portion 24 is hinged such that it can be opened to accept a structure and closed to clamp down onto the structure. Fasteners such as screws, may be used to keep the coupling portion in the closed position. One skilled in the art would appreciate that the couplers 104*a*, 104*b* could take a variety of forms and be located at various locations on the housing 103 depending on the intended use of the assembly 10.

In one embodiment, one of the couplers 104*a*, 104*b* includes, or is connected to, a stand. The stand, depending upon the embodiment, can be: (a) a weighted base configured to lie on a floor, pavement or ground; (b) a hollow container-type base configured to be filled with water or sand; (c) a spike or ground screw configured to be inserted into the ground or sand; or (d) a mounting base, such as a metal plate with a holes to receive bolts for bolting the umbrella assembly 10 to a cement or concrete pavement. The stand enables the umbrella assembly 10 to be stood upright for operation outdoors in a variety of settings.

Figure 5:
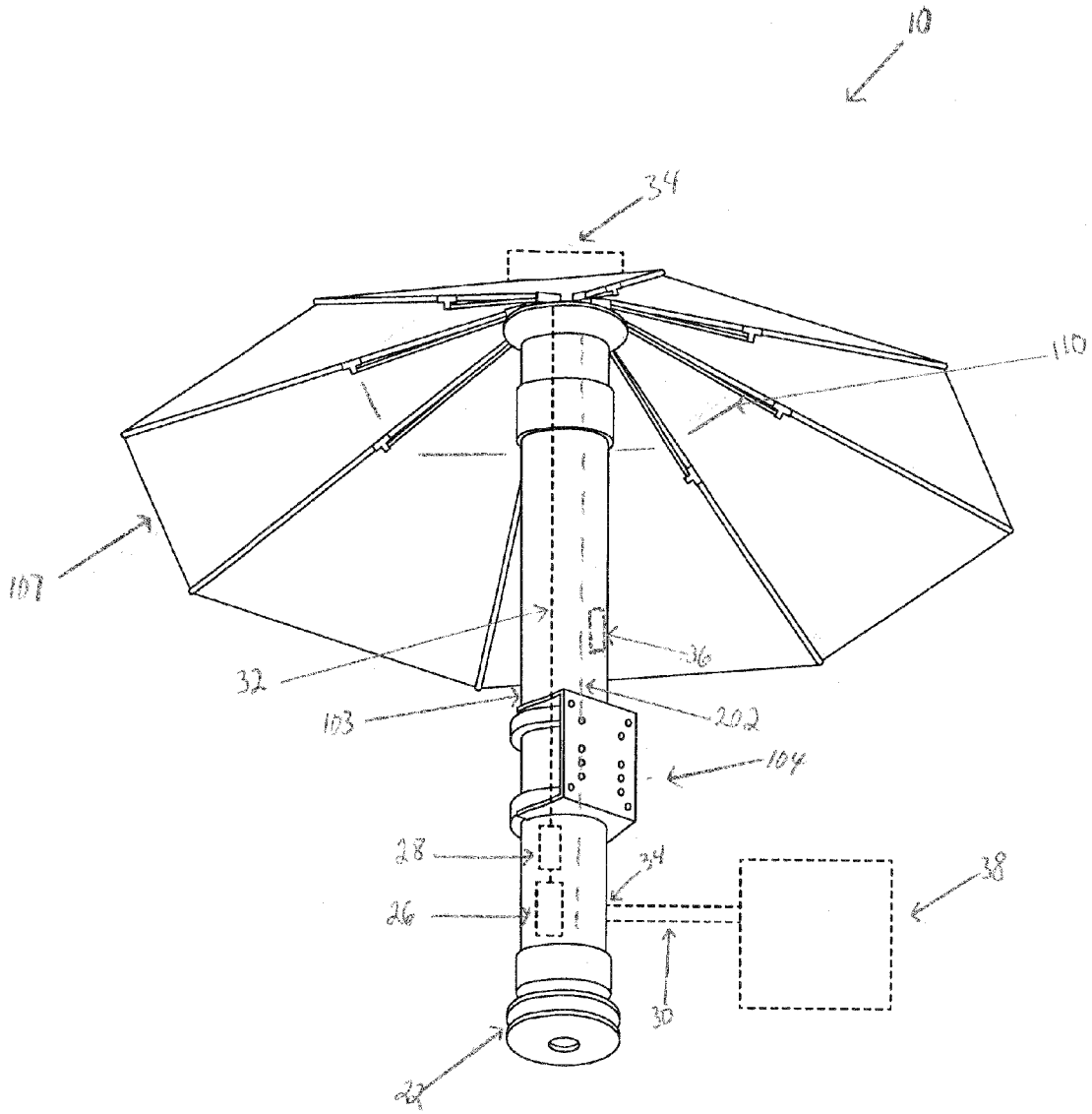
FIG. 5 is an isometric view of an embodiment of the umbrella assembly in a fully open position.

A support, stopper or stop member 105 is coupled to the housing 103 at the upper end 102. As described below with respect to FIG. 5, the stop member 105 supports the fingers or elongated ribs 106 during deployment and retraction of the canopy 107. In one embodiment, the canopy 107 includes one or more slits 110 (as seen in FIG. 5) configured to allow air flow through the canopy 107 without leaking. The canopy 107 can, depending upon the embodiment, include any fully flexible, partially flexible or collapsible rain or weather barrier, including, but not limited to, a tarp, sheet or cover constructed of any suitable material, including, but not limited to, fabric, polymer or plastic.

Figure 2:
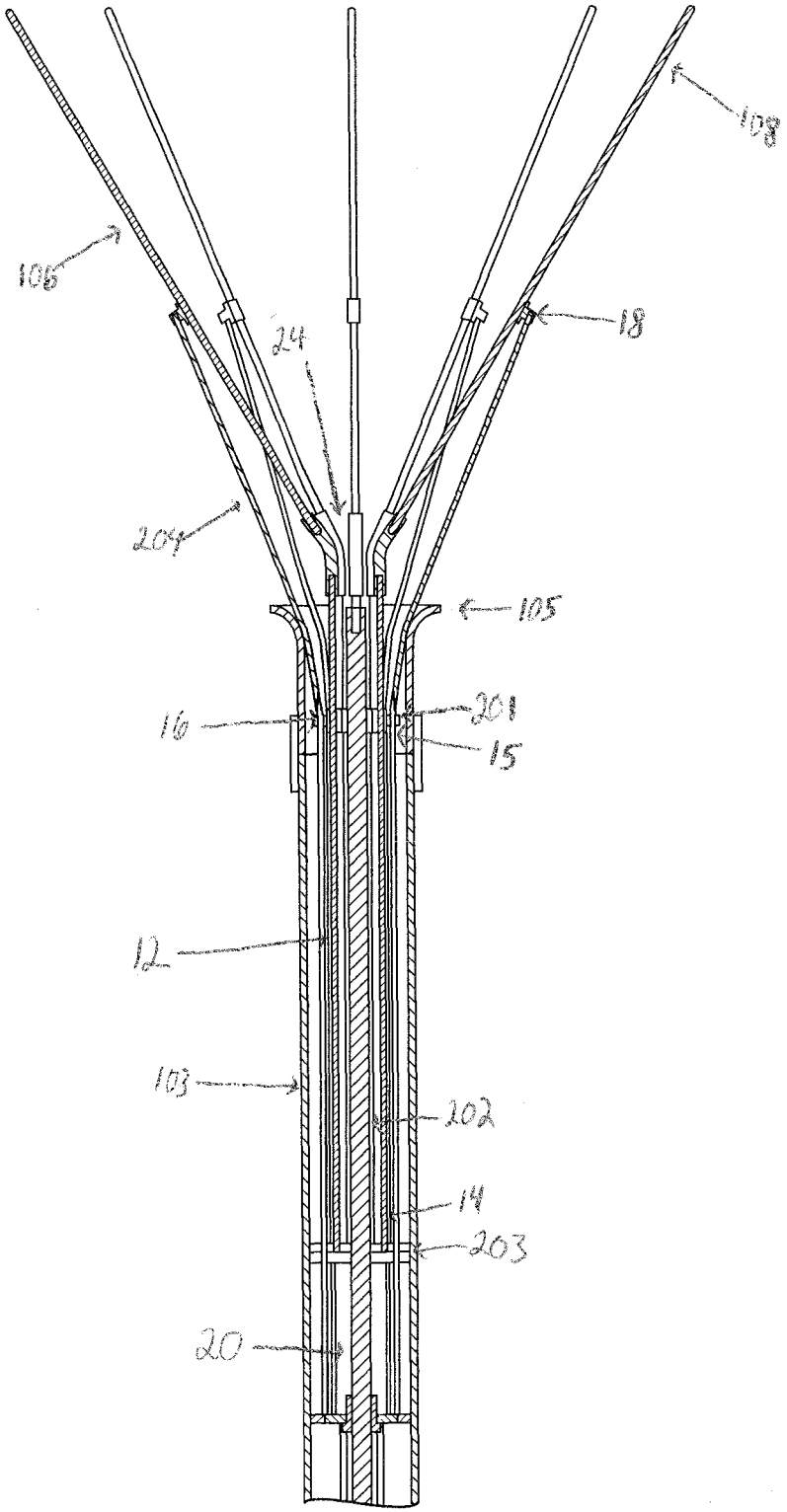
FIG. 2 is a cross section view of an embodiment of the umbrella assembly of FIG. 1 taken substantially along line 2-2 of FIG. 1.
Figure 3:
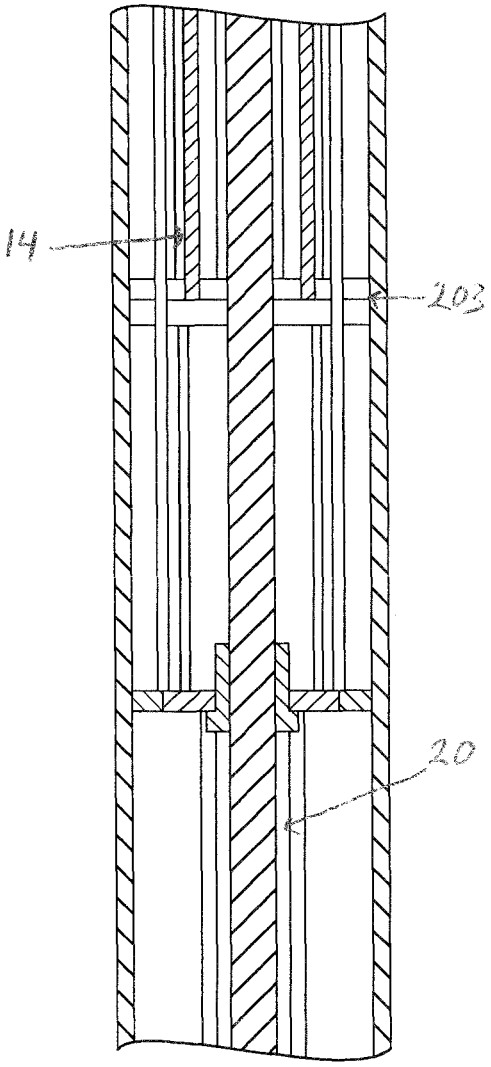
FIG. 3 is an enlarged, fragmentary view of a portion of the umbrella assembly of FIG. 2, illustrating the central part of the housing.
Figure 4:
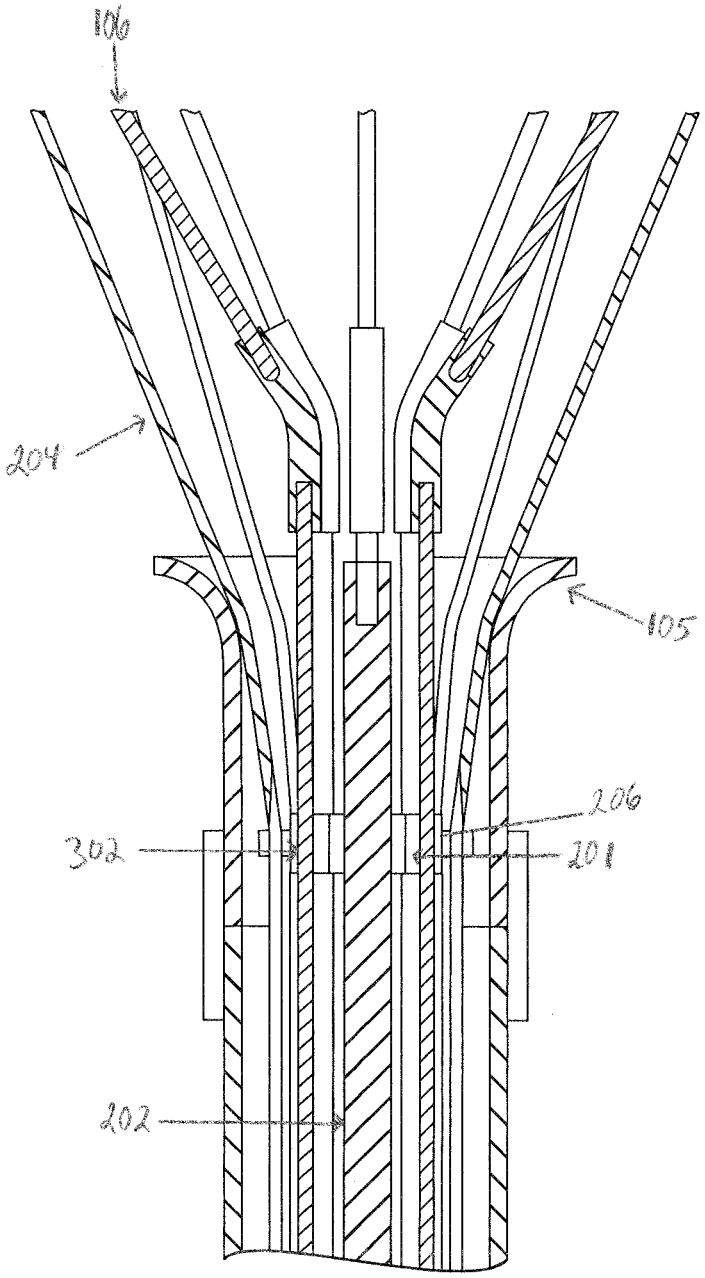
FIG. 4 is an enlarged, fragmentary view of a portion of the umbrella assembly of FIG. 2, illustrating the upper part of the housing.

Referring to FIGS. 2-4, an embodiment of the umbrella sub-assembly 12 operates to fold and unfold the canopy 107. The sub-assembly 12 includes: (a) a drive shaft, drive screw or drive member 202; (b) a guide, anchor or mount 203, such as a mount plate, defining an opening that receives the drive member and maintains the central position of the drive member 202 within the housing 103; (c) a drive plate or rib driver 201 operable to push the ribs 106 out of the housing 103 and to also pull the ribs 106 into the housing 103; (d) a plurality of fingers, tubular-shaped supports or elongated ribs 106 that are attached to the canopy 107; (e) a plurality of rib guides, rib directors, guide wires, rib angle controllers, flexible support members or elongated rib steering devices 204 operable to control the angular direction of the ribs 106; and (f) a plurality of rib connectors 18 which connect the rib steering devices 204 to the ribs 106.

The rib driver 201 is coupled or anchored to the ribs 106, serving as an anchoring surface 301 for the elongated ribs 106. The drive member 202, in one embodiment, has an outer thread or groove pattern. The rib driver 201 has an inner-threaded or inner-grooved opening configured to receive, and mate with, the threads or grooves of the drive member 202. In one embodiment, the outer surface of the rib driver 201 has a notch, and the inner surface of the housing 103 has a longitudinal groove which mates with the notch of the rib driver 201. The notch and groove engagement prevents the rib driver 201 from rotating as the drive member 202 rotates. As a result, the drive member 202 causes the rib driver 201 to slide up and down relative to the housing 103.

The mount 203 is, in one embodiment, fixed within the housing 103 and acts as a support and anchoring surface for the lower ends 14 of the rib steering devices 204. The lower ends 14 are fixedly secured to the mount 203. The upper ends 15 of rib steering devices 204 slideably pass through openings 302 in the rib driver 201 and are attached individually to the elongated ribs 106 through flexible joints 206. The elongated ribs 106 may comprise multiple rib sections 108 with each section coupled together such that the rib sections 108 can articulate independently of one another.

The ribs 106 and elongated rib steering devices 204 cooperate to control the opening, closing, positioning and stabilization of the canopy 107. Depending upon the embodiment, the ribs 106 and rib steering devices 204 can be fully flexible, partially flexible, semi-rigid, partially rigid, bendable or elastic, such as in an embodiment where ribs 106 or devices 204 have a leaf spring configuration.

In one embodiment, the rib connectors 18 fixedly attach the rib steering devices 204 to the ribs 106. In another embodiment, the rib connectors 18 slideably attach the rib steering devices 204 to the ribs 106.

In one embodiment, the drive member 202 is located within the housing 103. The lower end 20 of the drive member 202 is coupled or attached to a disk or pulley 22 which rotates the drive member 202 and causes the rib driver 201 to slide along the axis of the drive member 202. As the rib driver 201 slides along the drive member 202 towards the stop member 105, the elongated ribs 106 begin to emerge through the aperture 109 in a vertical orientation. The tension, or pulling force, from the rib steering devices 204 pulls the elongated ribs 106 downward against the inner surface of the stop member 105. As the elongated ribs 106 emerge from the aperture 109 and approach the stop member 105, they collectively form a cone-shaped formation having a general vertex location 24, as illustrated in FIG. 2.

As the elongated ribs 106 move from a closed umbrella position, where the ribs 106 are mostly or fully contained in the housing 103, to an open umbrella position, shown in FIG. 5, the increasing tension in the rib steering devices 204 pulls the elongated ribs 106 downward resulting in the deployment and stretching of the canopy 107. The motion and formation of the elongated ribs 106 mimics the blossoming of a flower and allows deployment over potential obstacles, such as people's heads, without the need to move the obstacle or the umbrella assembly 10.

In the fully deployed or open umbrella position, the rib steering devices 204 act to stabilize the canopy 107 to withstand, and counteract, an upward force of environmental elements. The stabilizing effect is due to the counteracting force of, and the tension in, the rib steering devices 204. This force is transmitted to the respective elongated ribs 106. In the fully deployed or open umbrella position, the elongated ribs 106 rest on the stop member 105. This helps to stabilize the canopy 107 to withstand a downward force of environmental elements, such as the downward force of rain, wind or snow.

Referring to FIG. 5, in one assembly not requiring pulley 22, the sub-assembly 12 includes: (a) an actuator 26 operatively coupled to the actuator and contained within the housing 103; (b) a rechargeable battery unit 28 mounted within the housing 103; (c) a solar power generator or solar panels 34 mounted to the canopy 107 or exterior of the housing 103; (d) a control switch, button or user input device 36 operable to activate the opening and closing of the umbrella assembly 10; (e) a power cord 30 operatively coupled to the actuator 26 for plugging into an external power source 38, such as an electrical outlet or wheelchair power supply unit; and (f) one or more circuit boards, transformers, circuitry components, electrical wires or electrical paths, such as electrical pathway 32, which operatively couple together the actuator 26, battery unit 28, solar panel 34 and user input device 36.

In one mode of operation, selectable through the input device 36, the power cord 30 delivers A/C current to charge the battery unit 28, and the battery unit 28 powers the operation of the actuator 26. In another mode of operation, selectable through the input device 36, the power cord 30 directly powers the actuator 26. In one embodiment, the solar panels 34 continuously converts sunlight to electrical power and charges the battery unit 28 or directly powers the actuator 26. In one embodiment, the solar panels 34 can be integrated into, or attached to, the top surface of the canopy 107. In one embodiment, the housing 103 holds a cord retractor configured to pull the power cord 30 into the housing 103 when the cord 30 is not in use.

The actuator 26 can include any electrical or electromechanical device operable to convert electrical energy to motion. Depending upon the embodiment, the actuator 26 can include: (a) an electrical motor with moving magnets and wound coil; (b) an electromagnet; or (c) a pump or pressure device operable to produce hydraulic fluid pressure or pneumatic pressure.

Referring still to FIG. 5, another embodiment may include a drive belt (not shown) configured to engage the pulley 22 at one end and the drive wheel of an actuator motor (not shown) at the other end. The pulley 22 can be configured to engage the drive member 202. The drive belt rotates the pulley 22 which, in turn, rotates the drive shaft or member 202, which, in turn, causes the deployment or retraction of the canopy 107. The drive member 202 rotates in one direction to open the umbrella assembly 10, and the drive member 202 rotates in the opposite direction to close the umbrella assembly 10. Depending upon the embodiment, the drive belt can be part of an attached structure, such as a vehicle or wheelchair which powers the movement of the drive belt.

The user input device 36, described above, can include a switch, dial, keypad, or the like. The user input device 36 can also be a device configured to receive a wireless signal from a remote control, mobile phone, computer or tablet. The umbrella assembly 10 includes a coupler 104, such as one of the couplers 104*a* or 104*b*, which enables the umbrella assembly 10 to be coupled to a variety of fixed or moveable structures as described above.

Figure 6:
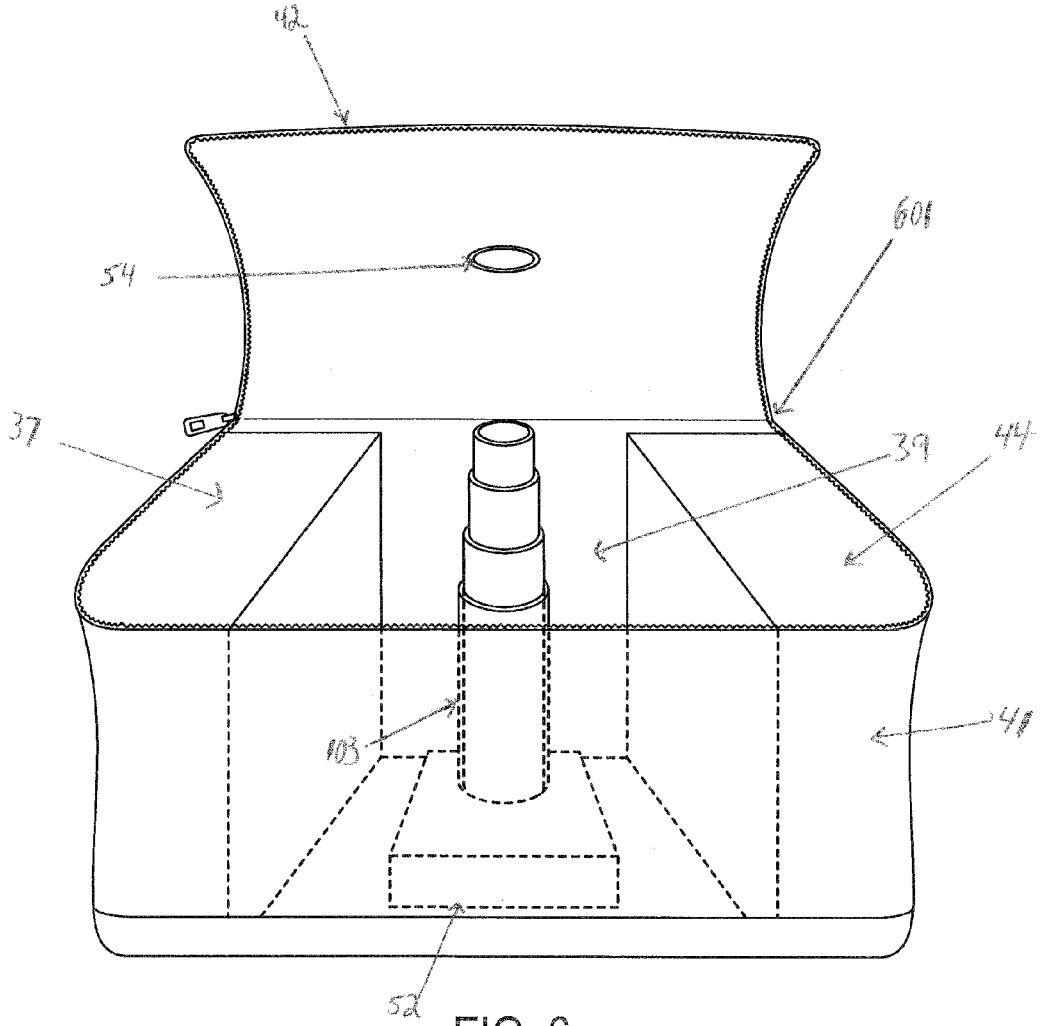
FIG. 6 is an isometric view of an embodiment of the umbrella assembly illustrating an embodiment of the portable pack of the umbrella assembly.
Figure 7:
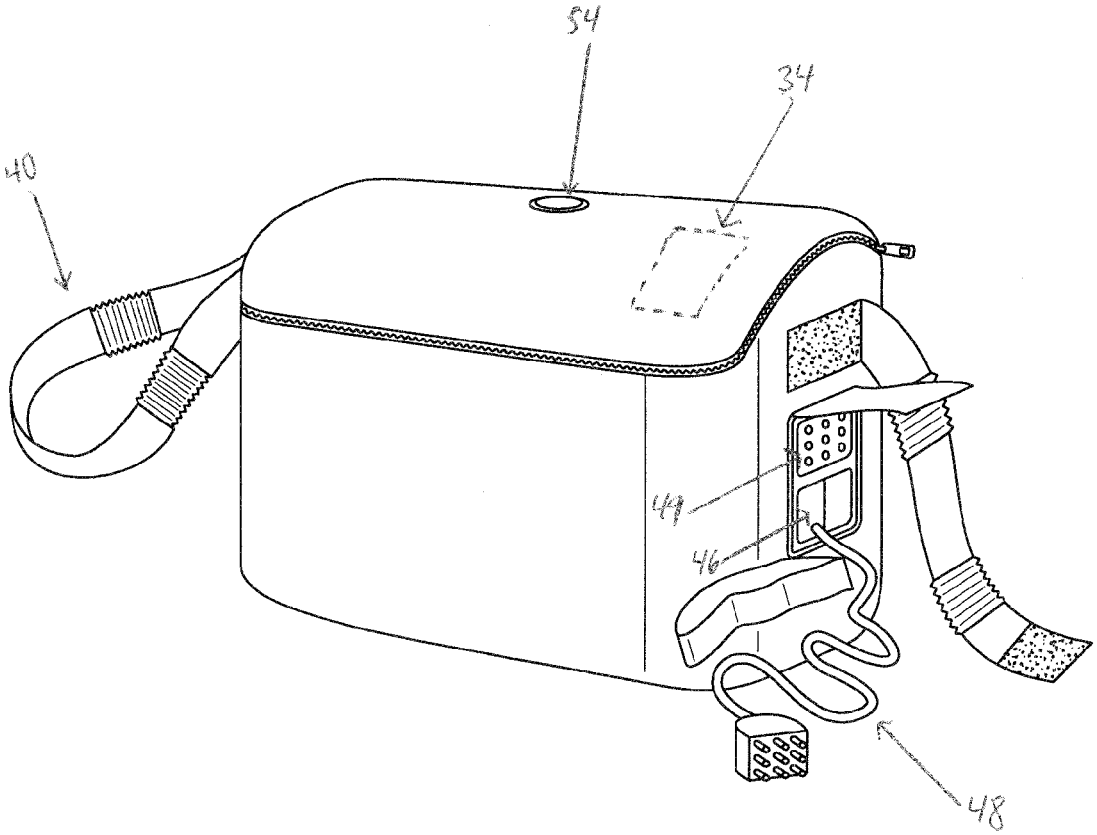
FIG. 7 is an isometric view of the umbrella assembly of FIG. 6, illustrating an embodiment of the battery unit and other electrical components of the portable pack.

Referring to FIGS. 6-7, another embodiment includes a portable holder or pack 601 that incorporates, and is configured to carry, some or all of the components of the umbrella assembly 10. The pack 601 includes a handle or strap 40 for easy carrying or for securing it to a fixed structure or mobile structure such as the frame of a wheelchair. The pack 601 includes a top portion 42 that allows access to the contents of the pack while in the open position. The top portion may also include one or more solar panels 34 configured to charge the battery unit 44. The interior of the pack 601 includes multiple compartments for holding the components of the assembly 10. One compartment is configured to hold the battery unit 44. The battery unit 44 includes a power port 46 accessible through one of the sides 41 of the pack 601 and is configured to allow the battery unit 44 to be coupled to an exterior power source for charging. The pack 601 may also be configured to have a compartment 49 for holding a power cord 48 or other power coupling device. Another compartment 37 is configured to hold a controller for the assembly 10, such as the controller 50 illustrated in FIG. 8. The controller allows a user to deploy and retract the canopy 107, to tilt and position the umbrella for optimal effect all with the press of a button. The controller can be attached to the assembly 10 by a cord or may operate wirelessly or by voice or motion commands. A central compartment 39 is configured to hold the umbrella assembly 10. The umbrella assembly 10 includes a base portion 52 which secures the assembly 10 to a surface of the pack 601 and may also contain electrical leads from the battery pack. The housing 103 is attached to the top surface of the base 52 and houses the mechanical and structural components of the assembly 10. The housing 103 includes multiple housing sections configured to expand and contract in a telescopic manner. The housing 103 also houses a mechanism for expanding and contracting the housing sections as well as a mechanism (such as actuator 26 and drive member 202) for deploying and retracting the canopy 107. The pack 601 defines a hole or aperture 54 configured to allow the housing 103 to extend outside the pack 601.

In one embodiment, the pack 601 is configured as a backpack (including, but not limited to, a hiking or school backpack or an infant carrier) with shoulder straps wearable by a user. In this embodiment, such backpack holds a relatively small-sized version of the umbrella assembly 10. Such small or miniature umbrella assembly 10 is operable to cover the head of the user and any carried infant.

Figure 8:
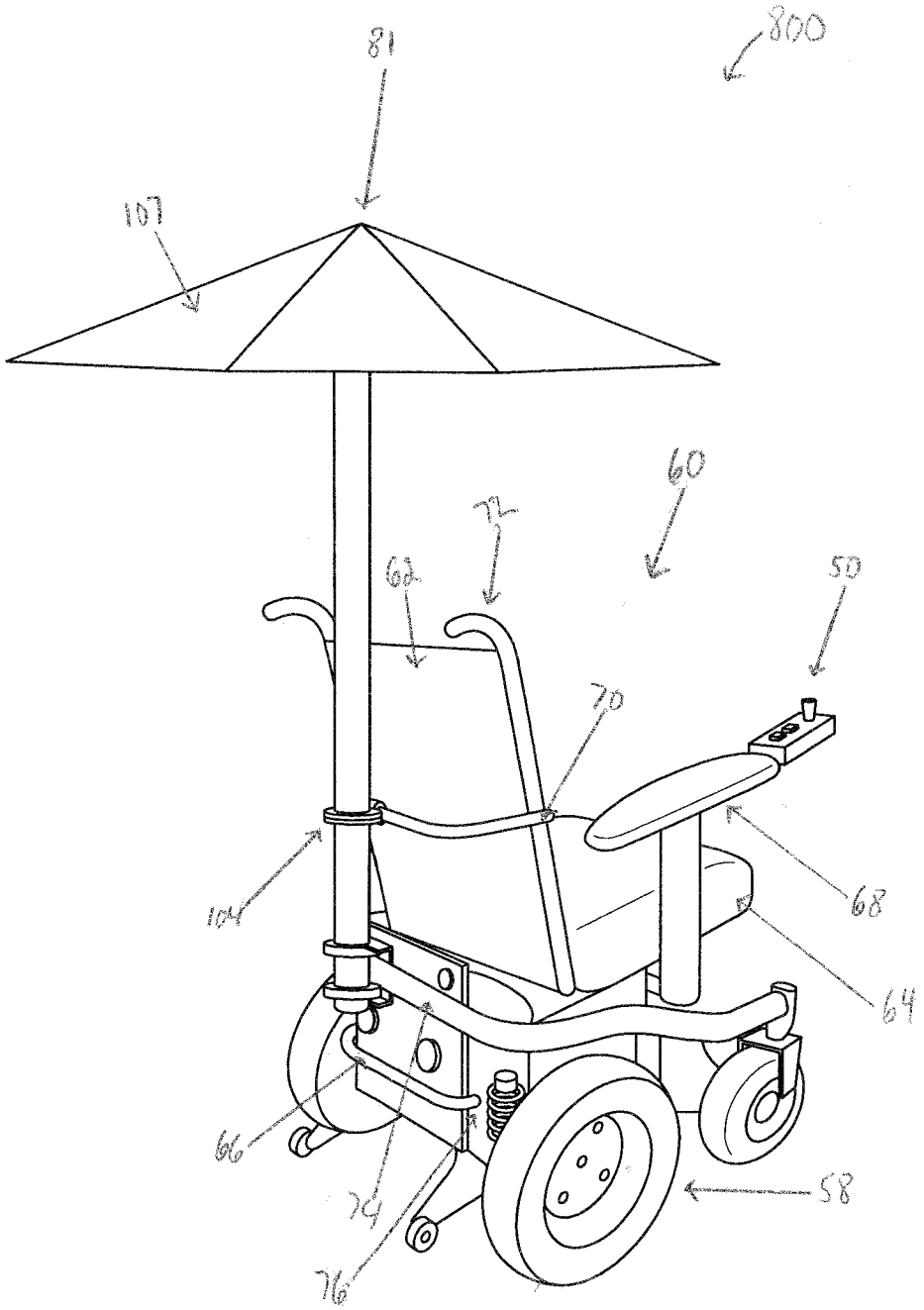
FIG. 8 is a rear, isometric view of an embodiment of a wheelchair having an attached wheelchair umbrella assembly.

Referring to FIG. 8, one embodiment includes a wheelchair 800 fitted with the umbrella assembly 10. This wheelchair 800, featuring the ease of use of the attached umbrella assembly 10, provides users with a greater degree of protection from sun, snow, rain and other conditions that might have harmful effects on the users. In the case of quadriplegics or others with limited or insufficient upper body strength or mobility, the umbrella assembly 10 enables such users to automatically shelter themselves from those weather conditions as a healthcare benefit.

Depending upon the embodiment, the umbrella assembly 10 can be permanently integrated with or detachably coupled to the back 802 of the wheelchair 800 as illustrated in FIG. 8. The wheelchair 800 has wheels 58, a seat 60 with a back 62 and a bottom portion of the seat 64 which is supported by a frame 66. The frame 66 has arms 68, support for the back of the seat 70 that extend up to the handles 72 and are supported by a sub-frame 74.

In the illustrated embodiment, the umbrella assembly 10 is removably attached to the wheelchair 800 as an aftermarket accessory. Specifically, the assembly 10 is attached to the sub-frame 74 through adjustable clamp couplers 104. The assembly 10 is also electrically connected to the control pad 50 and wheelchair battery unit 76. It will be appreciated that the user can easily deploy the umbrella assembly 10 to its extended, open position by hand operating the pad 50 while sitting in the chair. This eliminates the burden of having to standup, turn around, manipulate and hold a conventional umbrella.

The controller 50 can be connected to the umbrella opening mechanism, such as actuator 26, by wire or wirelessly or by voice activation or motion sensor. In the illustrated embodiment, there may be controls for activating (on/off), adjusting height and adjusting tilt. An additional benefit of the manner in which the canopy operates is that deployment and retraction can occur without interfering with the wheelchair user's head or other nearby objects, such as the seat back 62 of the wheelchair 800.

Figure 9:
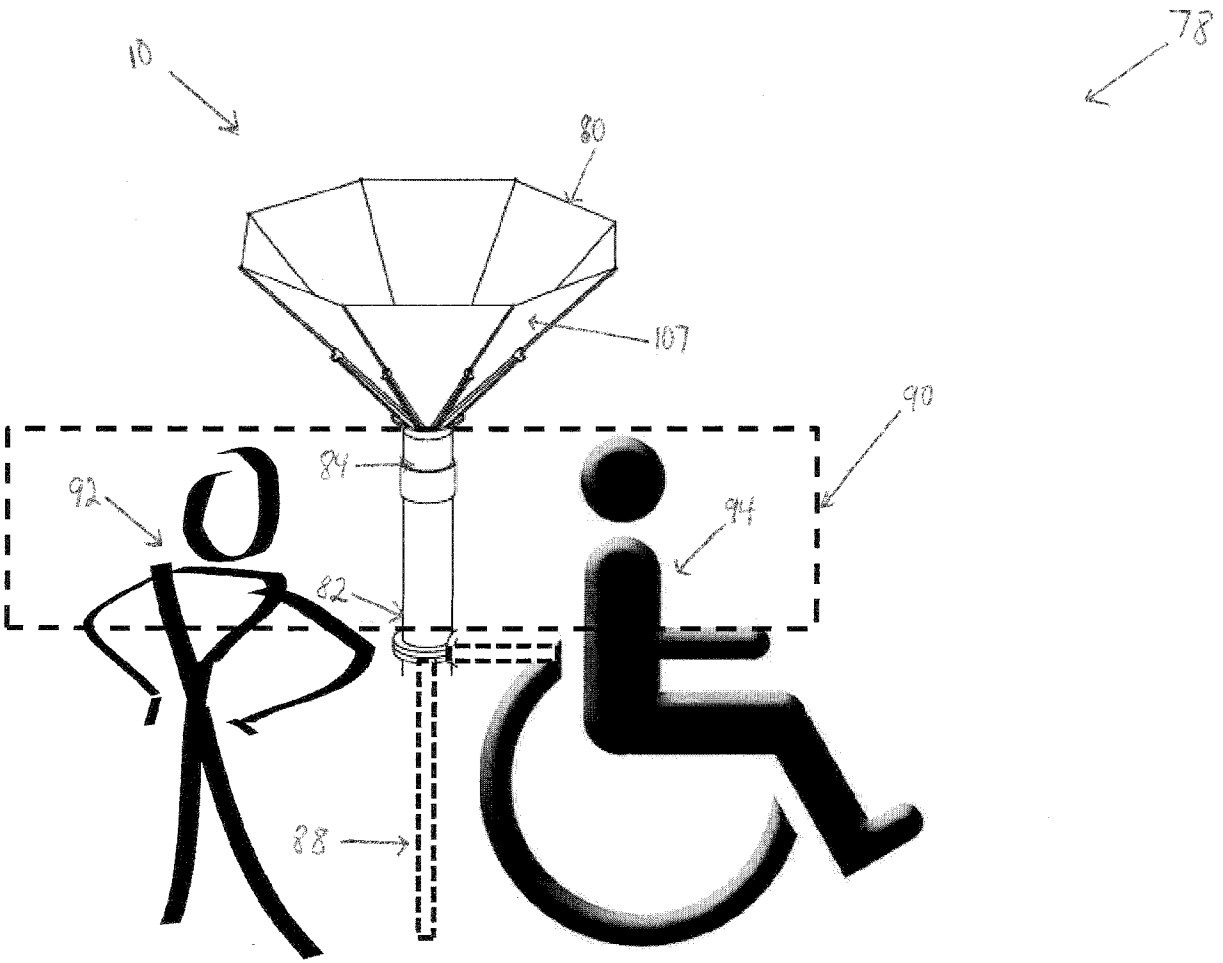
FIG. 9 is an isometric view of an embodiment of the umbrella assembly illustrating the blooming formation during the opening process.

Referring to FIG. 9, the umbrella assembly 10, in one embodiment, exhibits a blooming formation 78 during the opening process. To achieve this blooming formation, the canopy edge 80 starts with an initial upward position 84 inside of the housing 103. The canopy center 81 (shown in FIG. 8) starts with an initial downward position 82 inside of the housing 103. As the canopy center 81 slides upward through the housing 103, the canopy edge 80 protrudes from the housing 103, and the canopy 107 gradually forms a cone shape. The cone shape gradually expands providing the blooming formation. As illustrated, the umbrella assembly 10 can be attached to a wheelchair coupler 86 or stand 88 depending upon the embodiment.

Since the canopy edge 80 starts at the upward position 84, the canopy 107 does not move through the occupied space 90 during its upward movement. This is an important advantage compared to conventional umbrellas, where conventional canopy centers remain at the top position, and the conventional canopy edges start at the bottom position, swing outward and interfere with people 92 and other objects 94 in the occupied space 90.

In one embodiment, the umbrella assembly 10 includes one or more electrical sensors. The sensors are operatively coupled to the actuator 26. Based on signals from the sensors, the actuator deactivates the actuator 26 to prevent the canopy from interfering with nearby objects, such as a tree limb, sidewalk sign, pedestrian or the user's body. The umbrella assembly 10 also includes an audio generator including an audio controller and speaker. The audio generator produces a sound, such as a high pitch, beeping sound, to alert users and others of the upcoming opening or closing of the umbrella assembly 10.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An umbrella assembly comprising:

a housing extending along an axis;

a plurality of elongated ribs configured to be at least partially housed within the housing;

a canopy coupled to at least one of the elongated ribs, the canopy configured to be housed within the housing when the umbrella assembly is closed;

a position control assembly configured to be at least partially housed within the housing, the position control assembly including:

(a) at least one drive member configured to rotate to drive the elongated ribs between a plurality of positions including: (i) a first position in which at least portions of the elongated ribs are housed within the housing; and (ii) a second position in which the portions extend outside of the housing;

(b) at least one rib steering device coupled to each one of the elongated ribs, the at least one rib steering device configured to: (i) control an angle of the elongated rib relative to the axis; and (ii) stabilize the canopy to withstand an upward force of environmental elements;

(c) a drive element configured to threadably engage the at least one drive member and move along the axis as the at least one drive member rotates; and (d) a mount configured to engage the at least one drive member and remain in a fixed position on the axis as the at least one drive member rotates; and at least one stop member coupled to the housing, the stop member configured to: (i) support the elongated ribs when the elongated ribs are in the second position; and (ii) stabilize the canopy to withstand a downward force of environmental elements.

2. The umbrella assembly of claim 1, wherein the elongated ribs comprise a plurality of rib sections coupled to each other by a plurality of flexible joints.

3. The umbrella assembly of claim 1, wherein one end of each elongated rib is coupled to the drive element.

4. The umbrella assembly of claim 1, wherein one end of each rib steering device is coupled to the mount.

5. The umbrella assembly of claim 1, which includes an actuator configured to be operatively coupled to the drive member and a power source, the actuator being operable, when operatively coupled to the power source, to cause a change between: (a) a closed umbrella mode associated with the first position; and (b) an open umbrella mode associated with the second position.

6. The umbrella assembly of claim 5, wherein the housing comprises a lower housing portion, and wherein at least part of the actuator is positioned within the lower housing portion.

7. An umbrella assembly comprising:

a housing extending along an axis;

a plurality of elongated ribs configured to be at least partially housed within the housing;

a canopy coupled to at least one of the elongated ribs, the canopy configured to be housed within the housing;

a position control assembly configured to be at least partially housed within the housing, the position control assembly including:

(a) at least one drive member configured to drive the elongated ribs between a plurality of positions including: (i) a first position in which at least portions of the elongated ribs are housed within the housing; and (ii) a second position in which the portions extend outside of the housing; and (b) at least one rib steering device coupled to each one of the elongated ribs, the at least one rib steering device configured to: (i) control an angle of the elongated rib relative to the axis; and (ii) stabilize the canopy to withstand an upward force of environmental elements;

at least one stop member coupled to the housing, the stop member configured to: (i) support the elongated ribs when the elongated ribs are in the second position; and (ii) stabilize the canopy to withstand a downward force of environmental elements; and an actuator operatively coupled to the position control assembly, the actuator being positioned within the housing and configured to be operatively coupled to an electrical power source so as to cause a change between: (a) a closed umbrella mode associated with the first position; and (b) an open umbrella mode associated with the second position.

8. The umbrella assembly of claim 7, wherein the actuator comprises an element selected from the group consisting of a motor, an electromagnet and a pump.

9. The umbrella assembly of claim 7, including:

a drive element configured to threadably engage the at least one drive member and move along the axis as the at least one drive member rotates; and a mount configured to engage the at least one drive member and remain in a fixed position on the axis as the at one least drive member rotates.

10. The umbrella assembly of claim 9, wherein:

one end of each elongated rib is coupled to the drive element; and one end of each rib steering device is coupled to the mount.

11. The umbrella assembly of claim 9, wherein the housing comprises a lower housing portion, and the actuator is positioned within the lower housing portion.

12. The umbrella assembly of claim 11, wherein the housing comprises a housing exterior, the umbrella assembly comprising a user input device attached to the housing exterior, the user input device being operatively coupled to the actuator.

13. The umbrella assembly of claim 12, comprising a drive element configured to rotatably engage the at least one drive member, wherein the housing comprises an elongated shape and an upper housing portion, the upper housing portion further comprising a flared shape wherein at least a portion of the at least one stop member has an arc shape, the portion configured to engage the elongated ribs when the elongated ribs are in the second positions.

14. An umbrella assembly comprising:

a housing extending along an axis;

a canopy configured to be at least partially housed within housing, the canopy including a canopy center and a canopy edge; and at least one drive member moveably positioned within the housing, the drive member being configured to:

(a) cause the canopy center to move from an initial canopy center position within the housing to a final canopy center position located above the initial canopy center position; and (b) cause the canopy edge to move from an initial canopy edge position within the housing to a final canopy edge position located outside of the housing, wherein the canopy edge emerges from the housing before the canopy center reaches the final canopy center position; and an actuator operatively coupled to the at least one drive member, the actuator being at least partially positioned within the housing, the actuator being configured to:

receive an input signal; and in response to the input signal, control a change between the initial canopy center position and the final canopy center position.

15. A wheelchair comprising the umbrella assembly of claim 14, wherein the umbrella assembly comprises at least one coupler configured to couple the housing to the wheelchair.

16. The umbrella assembly of claim 14, wherein the canopy is coupled to at least one elongated rib, and the at least one elongated rib is at least partially housed within the housing when the canopy center is in the initial canopy center position.

17. A portable holder comprising the umbrella assembly of claim 14, wherein the housing has a telescopic configuration, the portable holder comprising a handle and a panel, the portable holder defining an interior space configured to receive the housing, wherein the panel is configured to be moved to provide access to the interior space.

18. The wheelchair of claim 15, comprising a controller, the controller configured to generate the input signal.

19. The umbrella assembly of claim 14, comprising a drive element configured to rotatably engage the at least one drive member, wherein the housing comprises a lower housing portion, the actuator being positioned within the lower housing portion.

20. The umbrella assembly of claim 19, wherein the housing comprising an upper housing portion, part of the upper housing portion comprising a flared shape wherein the part is configured to support the canopy in the final canopy center position.

* * * * *